US006422645B1

(12) United States Patent
Smith et al.

(10) Patent No.: US 6,422,645 B1
(45) Date of Patent: Jul. 23, 2002

(54) STORABLE FOLDING CHAIR

(75) Inventors: Richard D. Smith, Springville; David J. Laws, Provo, both of UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 09/425,586

(22) Filed: Oct. 22, 1999

(51) Int. Cl.[7] ..... A47C 4/00
(52) U.S. Cl. ..... 297/56; 297/239
(58) Field of Search ..... 297/239, 232, 297/56, 55

(56) References Cited

U.S. PATENT DOCUMENTS

| | | | | |
|---|---|---|---|---|
| 30,858 | A | * | 12/1860 | Pratt |
| 71,045 | A | * | 11/1867 | Nicolai |
| 116,811 | A | * | 7/1871 | Collignon |
| 128,767 | A | | 7/1872 | Viele |
| 133,503 | A | * | 11/1872 | Travis et al. |
| 169,748 | A | | 11/1875 | Wakefield |
| 190,827 | A | * | 5/1877 | Closterman, Jr. |
| 198,421 | A | | 12/1877 | Smith |
| 210,842 | A | * | 12/1878 | Dick |
| 451,556 | A | * | 5/1891 | Hallett |
| 473,704 | A | | 4/1892 | Le Count |
| 481,816 | A | * | 8/1892 | Perry |
| 504,446 | A | * | 9/1893 | Dodd |
| 779,327 | A | | 1/1905 | Stiggleman |
| 898,235 | A | * | 9/1908 | Lloyd |
| 945,032 | A | | 1/1910 | Gillespie |
| 976,786 | A | | 11/1910 | Moulin |
| 1,591,550 | A | | 7/1926 | Rosenthal |
| 1,608,911 | A | * | 11/1926 | Smith |
| 1,874,434 | A | * | 8/1932 | Brown |
| 1,975,622 | A | | 10/1934 | Schermerhorn |
| 1,989,865 | A | * | 2/1935 | Johanson |
| 2,303,189 | A | | 11/1942 | Adler |
| 2,514,125 | A | | 7/1950 | Evans |
| 2,568,269 | A | | 9/1951 | Burnham et al. |
| 2,874,755 | A | | 2/1959 | Smith |
| 3,001,816 | A | * | 9/1961 | Clarin |
| 3,087,755 | A | | 4/1963 | Boman |
| 3,220,764 | A | | 11/1965 | Duer |
| 3,639,001 | A | | 2/1972 | Anderson |
| 3,669,496 | A | | 6/1972 | Chisholm |
| 4,235,473 | A | | 11/1980 | Aginar |
| 4,319,779 | A | | 3/1982 | Leonhart |
| 5,040,848 | A | | 8/1991 | Irie et al. |
| 5,071,191 | A | | 12/1991 | Leib |
| 5,096,259 | A | | 3/1992 | Stanfield |
| 5,383,712 | A | | 1/1995 | Perry |
| 5,825,095 | A | | 10/1998 | Albecker, III |
| 6,056,354 | A | * | 5/2000 | Tseng |

* cited by examiner

*Primary Examiner*—Milton Nelson, Jr.
(74) *Attorney, Agent, or Firm*—Thorpe North & Western

(57) ABSTRACT

A folding chair has a rigid support frame with a curved spline profile, and a seat and rear legs which fold into a closed position and substantially collapse within a volume defined by the support frame to maximize stacking density, and to increase stability with the curved spline profiles nesting within one another. The support frame has first and second rigid side support members, each with an upper back support portion and extending forwardly to form front leg portions. The back support portion and the front leg portions are integrally and rigidly connected to advantageously form a curved spline profile. A seat is pivotally coupled to the support frame, or to and between the first and second support members. A majority of the seat advantageously collapses to a folded position within a volume defined between the first and second rigid side support members. Rear legs are pivotally coupled to the support frame, or to the respective first and second support members. A majority of the rear legs advantageously collapses to a folded position within the volume defined by the support frame between the first and second rigid support members.

58 Claims, 5 Drawing Sheets

STORABLE FOLDING CHAIR

BACKGROUND OF THE INVENTION

1. The Field of the Invention.

The present invention relates generally to a folding chair, and/or a stackable/storable folding chair system. More particularly, the present invention relates to a folding chair having a frame with a curved spline profile, and having a seat and legs which fold or collapse into a volume defined by the frame, such that a number of folded chairs may be stacked adjacent one another with the curved spline profiles of the frames nesting or indexing the chairs in a dense, stable relationship.

2. The Background Art

Folding chairs are often used in situations in which it is desirable or necessary to provide varying numbers and/or varying layouts of chairs, such as during conventions, seminars, conferences, etc. In addition, folding chairs are often used in multipurpose areas in which patron seating is required for some functions, but a large open space is required for other functions necessitating storage of the chairs. For example, some organizations have buildings with a multipurpose room which may be used for banquets, seminars, conventions, etc., with chairs set up, or for a dance, sporting event, etc., with the folding chairs removed.

It is desirable that the folding chairs be capable of being folded and stacked for storage so that the chairs take up less room when they are not required. It will be appreciated that some situations or events will require thousands of folding chairs, all of which may need to be folded and stored at any given period. Thus, the chairs must be folded and stored such that they have a high storage density to minimize the storage space required. It will be appreciated that any extra thickness of a chair when folded becomes significant when numerous folding chairs are involved. For example, with a thousand stacked folding chairs, a folding chair which saves one extra inch in the folded position results in over 80 linear feet of saved storage space.

One disadvantage with many prior art folding chairs is the bulk or thickness of the chair in the folded position. Many typical folding chairs still remain several inches thick in the folded position, and thus are less dense when stored. For example, many typical folding chairs have seats which fold adjacent to or abutting the legs, and/or have front and back legs which fold against one another, such that the thickness of the chairs in the folded position comprises the thickness of both the front and rear legs, and/or the thickness of the legs and the seat. Another disadvantage of many conventional folding chairs is that they fold awkwardly, with bulky folded configurations and/or various protruding members.

In addition, it is desirable that the folding chairs be easily storable or stackable, and be stable when stored/stacked. Many typical prior art folding chairs are stored merely by leaning one chair against a wall and subsequent chairs in a series against the first chair. It will be appreciated that a plurality of folding chairs stacked against a wall have a potential domino effect, with all of the chairs subject to being knocked over. Other prior art folding chairs have complicated and expensive hanging rack systems. For example, a wheeled cart might have a plurality of support arms from which a plurality of folding chairs are suspended. One disadvantage of these types of systems is that chairs on the end of the hangers tend to fall off the rack, and the wheeled racks are difficult to move and maneuver.

Some types of prior art folding chairs have back rest portions which protrude from the chair and into an adjacent folding chair. For example, a folding chair may have a back portion which curves outwardly to protrude from the frame of the chair, and into the frame of and adjacent folding chair. Although this relationship allows the chairs to be stored with greater density, the chairs tend to be unstable in a stored position. The broad rounded backs of the chairs act as ramps which, fail to resist movement of an adjacent chair. In addition, the chairs are still relatively thick and bulky.

It also is desirable that the chairs be easy to set up and take down, or fold and unfold. It will be appreciated that there is considerable time involved in setting up and taking down thousands of chairs. One disadvantage of many prior art folding chairs is that they are difficult to both unfold and fold. For example, most folding chairs require the person to use both hands to fold and unfold the chair. One hand usually has to grasp the back of the chair while the other hand has to grab and pivot the seat in or out.

It also is desirable that the chairs be comfortable. Typical prior art folding chairs have rigid metal seats and seat backs which can be hard and uncomfortable. One disadvantage of many prior art folding chairs is that the chairs either fold well and are uncomfortable, or are comfortable but are awkward in folding. Thus, there tends to be a trade off between comfort and foldability. Some chairs provide a cushion. But these chairs still utilize the rigid metal seat bottoms and seat backs, and the cushions tend to make the chairs even thicker when folded.

In addition, it is desirable that the chair provide proper support, or be ergonomically designed. One disadvantage of many prior art chairs is that the angle between the back rest and the seat is dictated by the folding mechanism of the chair. Thus, in an effort to create a folding chair, the proper ergonomic design of the back rest and seat is often compromised in order to obtain a chair that folds more easily.

Another disadvantage of many typical prior art folding chairs is that they have a relatively small back support which may not adequately support a user's back. The small back support is often a function of the folding configuration of the chair. Again, the back support is often compromised in order to obtain a chair that folds. For example, the seat may be configured to fold upwardly or towards the back support, so that a relatively large space must exist between the back support and the seat so that the seat may fold into that space. That space is usually located where a user requires back support.

It also is desirable that the folding chair be durable. It will be appreciated that the chair will be alternately stored and used, folded and unfolded, innumerable times. Similarly, it is desirable that the folding chair be strong. The chair must be able to support persons of various weight, often in potentially abusive conditions.

It also is desirable that the folding chair be safe. It will be appreciated that as the various parts of the chair fold, there is a potential for fingers and the like to become pinched within the folding mechanisms.

Therefore, it would be advantageous to develop a folding chair capable of folding for high density storage. It also would be advantageous to develop such a folding chair which is more stable and safe in the folded and stored position. It would further be advantageous to develop a folding chair which (i) may be easily folded and unfolded; (ii) is comfortable and safe; and (iii) is durable, strong, and cost effective.

OBJECTS AND SUMMARY OF THE INVENTION

It is therefore an object of the present invention to provide a folding chair which folds relatively thin to maximize storage density.

It is another object of the present invention to provide such a folding chair which stores safely and is stable when stored, and/or stacked.

It is another object of the present invention to provide a folding chair which is easily folded and unfolded.

It is yet another object of the present invention to provide a folding chair which is'safe and comfortable.

It is yet another object of the present invention to provide a folding chair which is durable, strong, and cost effective.

The above objects and others not specifically recited are realized in a specific illustrative embodiment of a folding chair having a rigid support frame with a curved spline profile, and a seat and rear legs which fold into a closed position and substantially collapse within a volume defined by the support frame, such that the chair maximizes stacking density, and such that folded chairs have the curved spline profile to nest within one another and resist relative movement.

The support frame has first and second rigid side support members, each with an upper back support portion and extending forwardly to form front leg portions. The back support portion and the front leg portions are integrally and rigidly connected to advantageously form a curved spline profile.

A seat is pivotally coupled to the support frame, or to and between the first and second support members. A majority of the seat advantageously collapses to a folded position within a volume defined between the first and second rigid side support members.

Rear legs are pivotally coupled to the support frame, or to the respective first and second support members. A majority of the rear legs advantageously collapse to a folded position within the volume defined by the support frame between the first and second rigid support members.

In the folded position, the chair is relatively thin, and is substantially contained within the support frame and the curved spline profile. Thus, a plurality of chairs advantageously are able to be stacked together with a very high density. In addition, the chairs have a substantially curved spline profile in the folded position. The first and second support members, the seat and the rear legs have a curved spline profile of substantially uniform thickness in the closed folded position. The curved spline profile forms a protrusion and a recess such that a protrusion of a first folding chair may nest with a recess of a second folding chair. Thus, a plurality of chairs advantageously are able to nest together for greater stability.

In accordance with one aspect of the present invention, the support frame and first and second support members preferably are shaped to form a composite curve with an s-shape.

In accordance with another aspect of the present invention, the front leg portions and rear legs are curved. The rear legs advantageously have a radius of curvature smaller than a radius of curvature of the front leg portions. The smaller radius of curvature of the rear legs allows the rear legs to pivot substantially between the front leg portions in the closed folded position. In addition, a bottom portion of the rear legs advantageously extends beyond the volume defined by the rigid support frame when the chair is in a folded position. Thus, the bottom portion of the rear legs advantageously nests with the front leg portions of a second adjacent folding chair to resist lateral relative movement and increase stability of the stacked chairs.

In accordance with another aspect of the present invention, front and rear cross support members couple together the respective front leg portions and the rear legs. At least the front cross support member has left and right channels for substantially receiving a section of a rigid support frame of a second folding chair to increase stability, and to allow the rear legs to further collapse within the volume of the frame.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
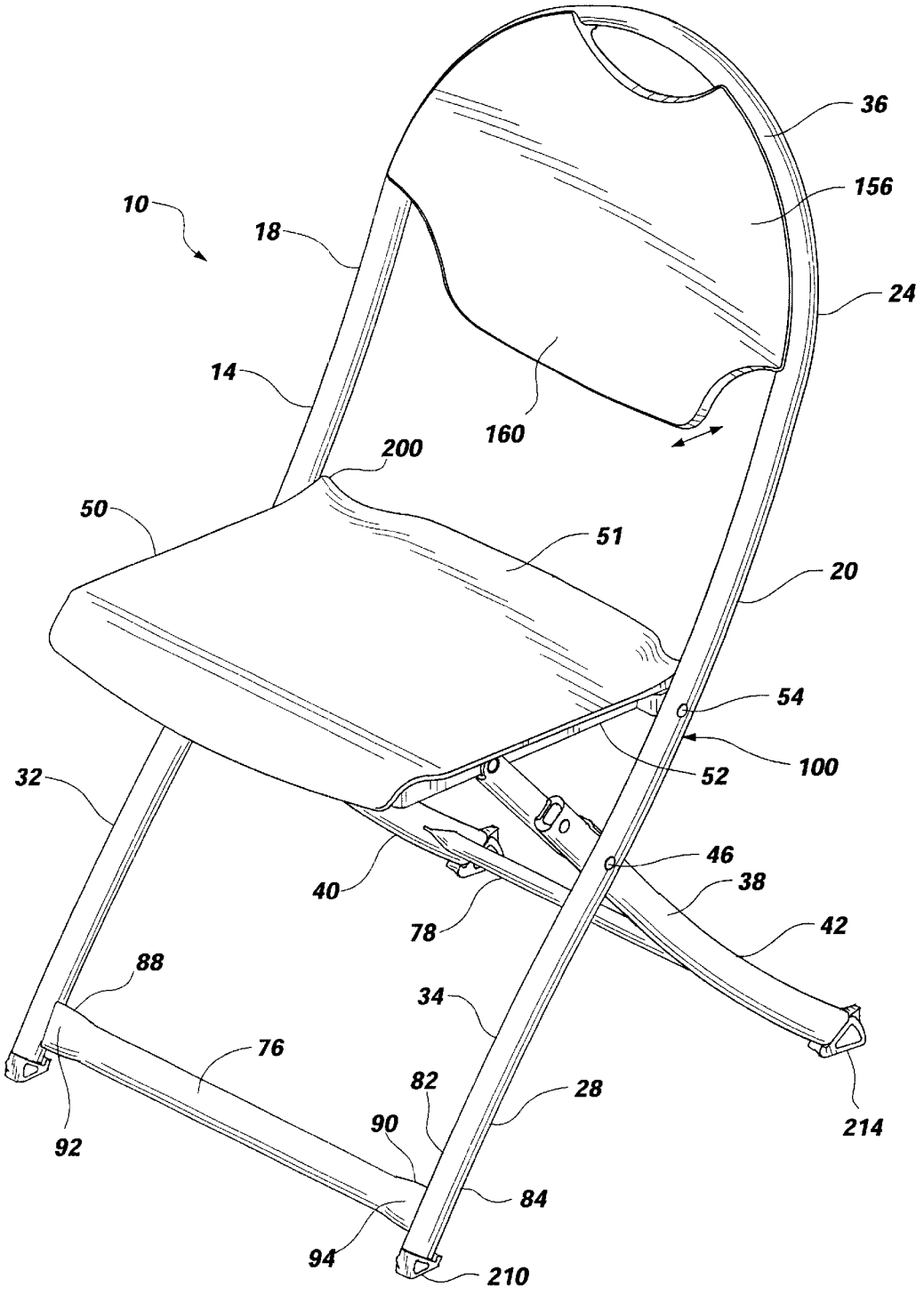
FIG. 1 is a perspective view of a preferred embodiment of a folding chair in accordance with the present invention in a first open unfolded position.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 3:
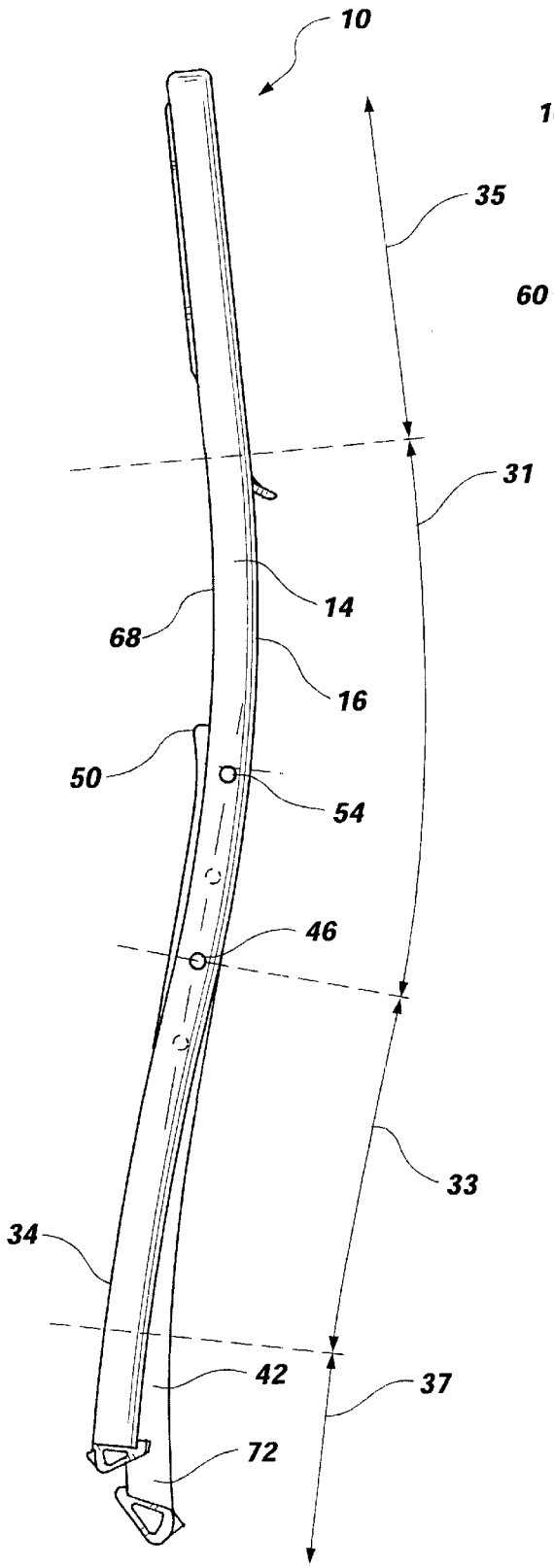
FIG. 3 is a side view of the preferred embodiment of the folding chair of the present invention in a second closed folded position.
Figure 4:
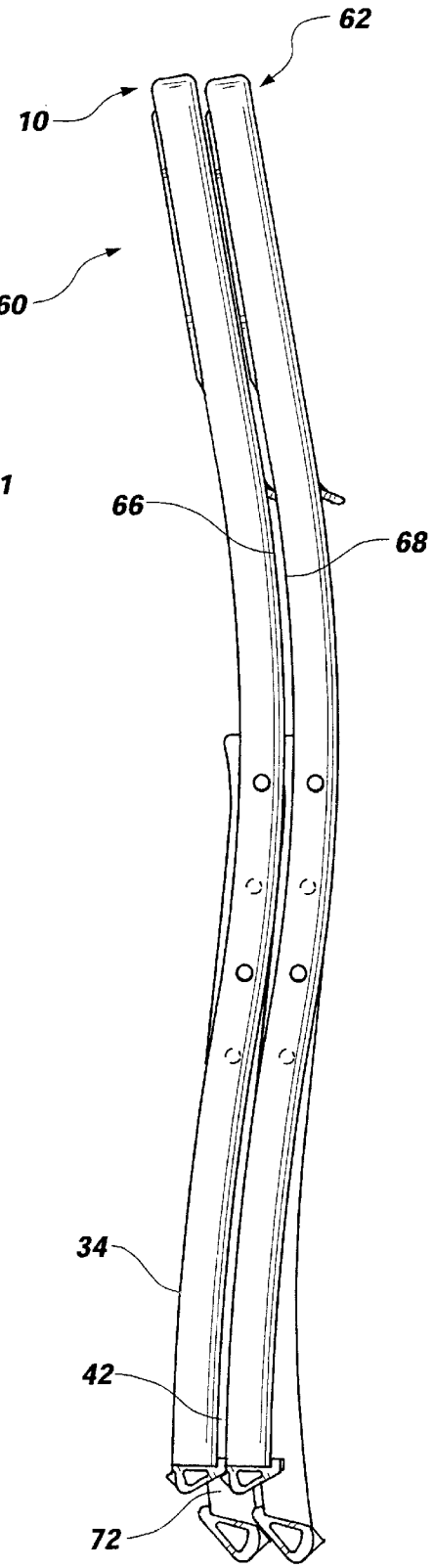
FIG. 4 is a side view of the preferred embodiment of a storable/stackable folding chair system of the present invention showing two folding chairs in the folded position which are disposed adjacent one another in a nesting or indexing relationship.

As illustrated in FIG. 1, a folding chair, indicated at 10, in accordance with the present invention, is shown in a first, open, unfolded orientation or position. As indicated above, typical prior art chairs fold into a thick, awkward or bulky shape or configuration, or have significant protruding members, such that typical prior art folding chairs are less dense when stored, and require more space for storage. The folding chair 10 of the present invention utilizes a new approach in which the chair 10 is designed or configured to fold or collapse into a minimum thickness, such that the chairs 10 of the present invention have a very high storage density, while still providing strength, comfort, and durability. Thus, when folded, the chair 10 of the present invention advantageously is thin or presents a minimal profile, as shown in FIG. 3. In addition, the thin profile of the chair 10 advantageously is shaped or configured to facilitate nesting or indexing with adjacent chairs, as shown in FIG. 4.

The shape of the thin profile of the chair of the present invention 10 may take various configurations. For example, the profile may be broadly convex, or broadly concave, as shown in FIGS. 2*b* and 2*c*, respectively. The broad single convex or concave curve is more cost effective to manufacture because it is easy to produce, and requires less expensive tooling. The convex curvature may provide greater structural integrity, while the concave profile may provide more comfortable sitting angles. Alternatively, the profile may be a composite curve with opposite curvatures forming an s-shape profile, as shown in FIGS. 2*d* and 2*e*. Such an s-shape profile may be less cost effective because it is more difficult to manufacture, and requires more expensive tooling. The s-shape profile, however, combines the structural rigidity of a convex curve and the more comfortable sitting angles of the concave curvature. In addition, the profile may have relatively straight ends, and a composite curve with an s-shape formed between the two straight ends, as shown in FIG. 3.

It will be appreciated that the curved profiles as shown and described above are merely a few examples of the numerous curved configurations which may be available. In addition, there are innumerable straight spline profiles which may be available, as shown in FIG. 2*f*. The curved or straight profiles provide the advantage of nesting or mating with adjacent profiles when the chairs are in a folded position for storage. All of the embodiments advantageously comprise elements which fold or collapse within a volume defined by the thin profile itself, thus resulting in a very dense stacking arrangement.

Figure 2:
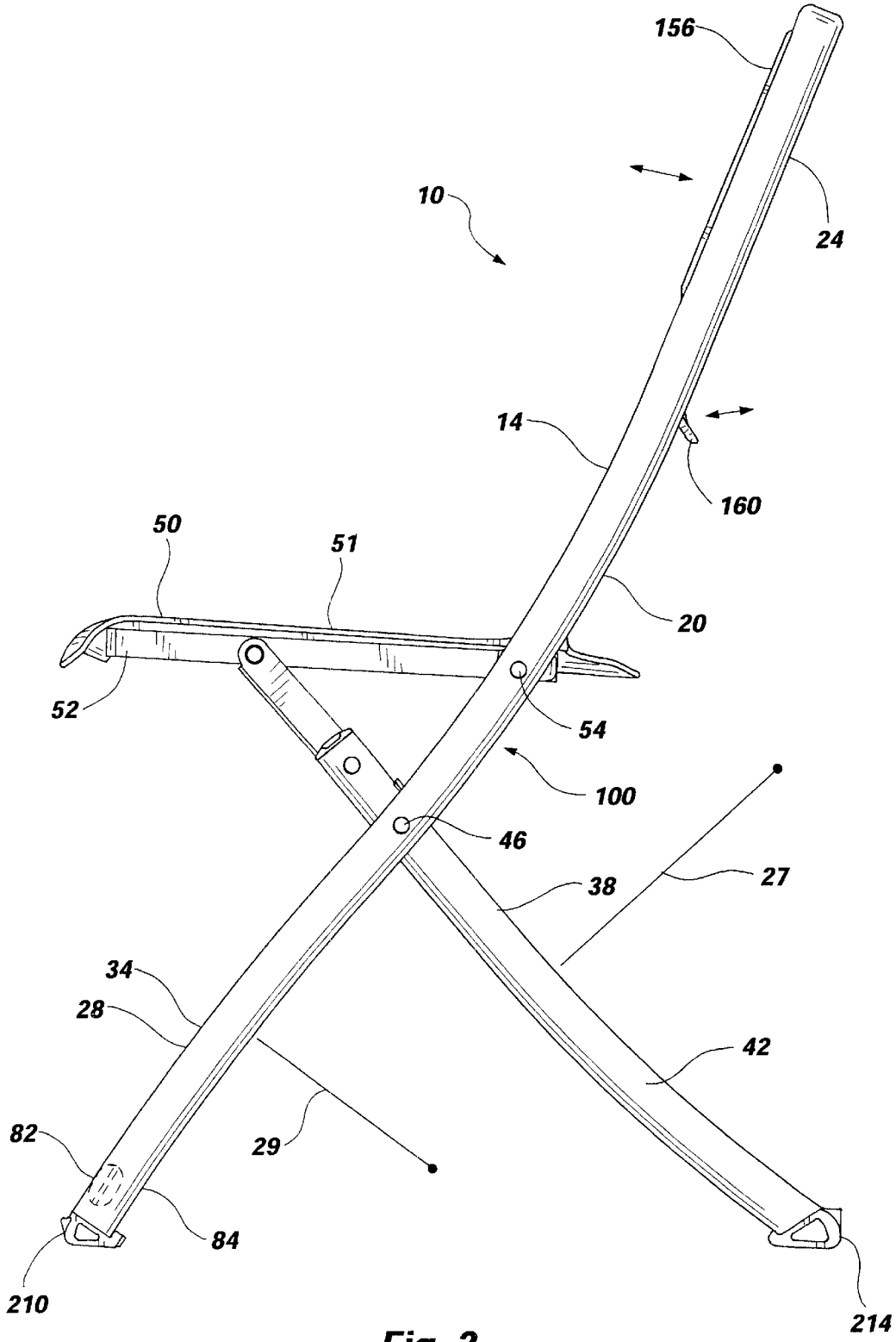
FIG. 2 is a side view of the preferred embodiment of the folding chair in accordance with the present invention in the first open unfolded position.
Figure 2C:
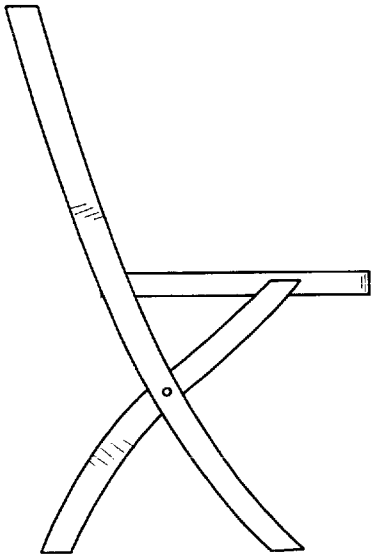
FIGS. 2*b*–2*f* are side views of alternative preferred embodiments of folding chairs in accordance with the present invention in the first open unfolded position.
Figure 2D:
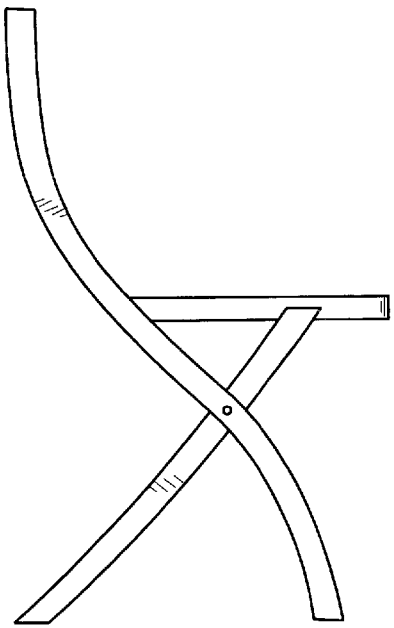
Figure 2B:
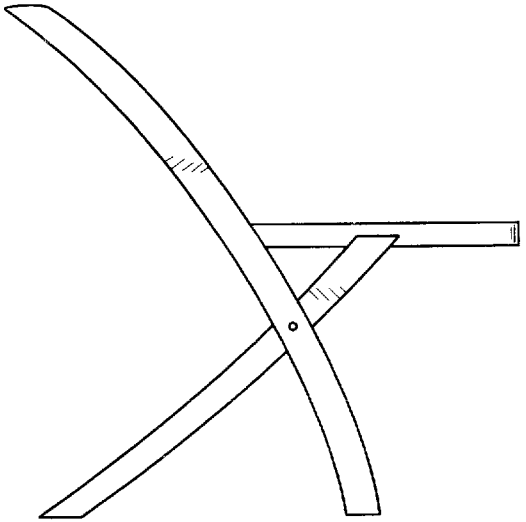
Figure 2F:
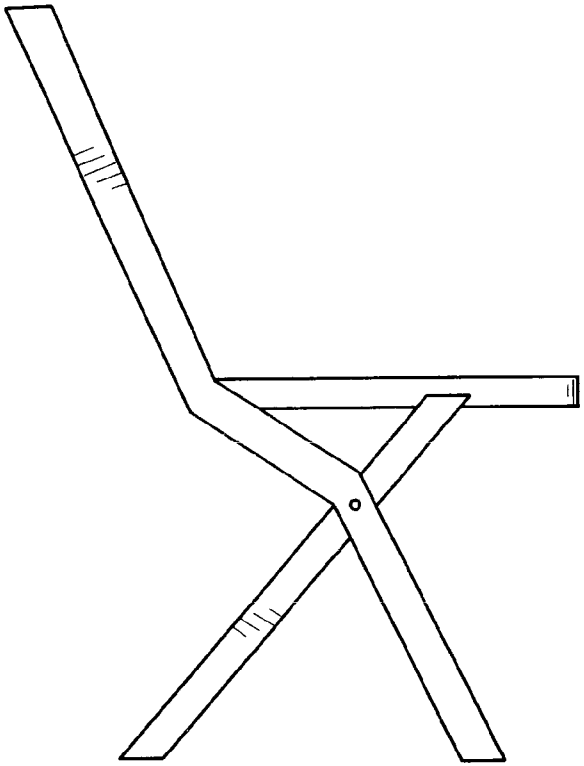
Figure 2E:
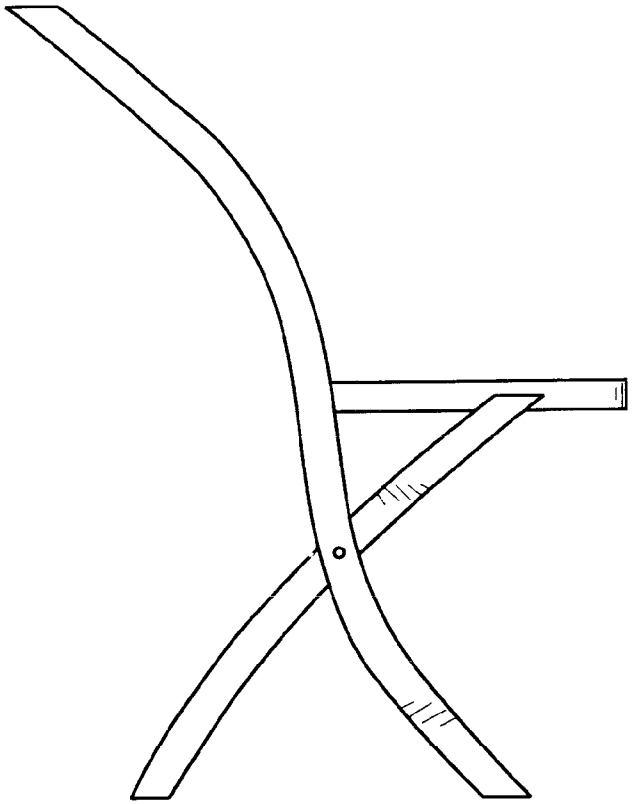

Referring to FIGS. 1 and 2, the folding chair 10 has a rigid support frame 14 including left and right, or first and second, rigid side supports 18 and 20, as shown in FIG. 1. As indicated above, it is desirable that the chair 10 be durable and strong. Thus, the rigid nature of the support frame 14 increases the durability and strength of the chair 10.

Preferably, the support frame 14 is formed from a tubular material to optimize strength and weight. In addition, the tubular material preferably has an elongated cross-sectional shape which is oriented generally vertically to increase the weight capacity of the chair 10. Furthermore, the tubular material preferably has rounded corners, or most preferably has an oval cross-sectional shape, giving soft edges to the frame 14 which are more comfortable.

The support frame 14, and side supports 18 and 20, have an upper back support portion 24 forming the back of the chair 10, and a lower front leg portion 28 formed integrally and continuously with the upper back support portion 24. The back support portion 24 extends forwardly from the back of the chair 10 to the lower front leg portions 28. Thus, the first and second side supports 18 and 20, or the upper and lower portions 24 and 28 thereof, are unitary, integral, and rigid structures to increase strength and durability. The front leg portion 28 preferably includes left and right, or first and second, front legs 32 and 34. In addition, the support frame 14, or side supports 18 and 20, may be a single integral member with a broad curved back member 36 formed at the tops of the side supports 18 and 20, as shown.

As indicated above, the rigid support frame 14 preferably is shaped to form a curved spline profile. As used herein, the term "curved spline" is used broadly to describe an elongated member with at least a curved portion, and which may include multiple curves and/or straight portions as well. For example, the curved spline may be a single continuous curve such as the broadly convex or concave curves shown in FIGS. 2*b* and 2*c*. As another example, the curved spline may be a compound curve including two oppositely curved portions joined end to end to form an s-shape, as shown in FIGS. 2*d* and 2*e*. As a further example, the curved spline may include two oppositely curved portions 31 and 33 joined end to end to form an s-shape, as shown in FIG. 3. The curved spline may further include straight end portion 35 and straight or curved end portion 37 coupled therebetween by a compound curve, as shown in FIG. 3. The profile is an elongated continuous profile having a substantially uniform thickness which is relatively thin when all elements are collapsed within the profile. The thin uniform profile contributes to a higher storage density of the chairs.

The chair 10 also includes a rear leg portion 38, which preferably includes left and right, or first and second, rear legs 40 and 42, as shown in FIG. 1. The rear leg portion 38, or rear legs 40 and 42, are pivotally coupled to the support frame 14 at leg pivot points 46. The leg pivot points 46 are preferably fixed pivot points, such that the rear legs 40 and 42 pivot with respect, to the support frame 14 or front legs 32 and 34.

In addition, the chair 10 includes a seat or seat portion 50 pivotally coupled to the support frame 14, and between the side supports 18 and 20 at seat pivot points 54. Again, the seat pivot points 54 are preferably fixed pivot points such that the seat 50 pivots with respect to the support frame 14, rather than sliding. The seat 50 and rear legs 40 and 42 also are pivotally connected as discussed in greater detail below.

The seat 50 may comprise a seating surface 51 secured to a seat frame 52. The seat frame 52 may extend generally around the perimeter of the seat 50, or along the sides, front and back of the seat 50. This provides an advantage where the seat may flex in response to a load, as discussed below. The seating surface 51 is, disposed on the seat frame 52, and spans the distance between the perimeter of the frame 52. Preferably, the seating surface 51 is formed of a flexible material, and flexes, bends, or deflects downwardly and into the seat frame 52 in response to, and proportional to, a user's weight. The flexibility, of the seating surface 51 is enabled because of the perimeter location of the seat frame 52, and allows the seating surface 51 to cup or curve, and thus conform to the user for a custom fit. In addition, the seating surface 51 preferably is coupled to the seat frame 52 only at the front and back, and not at the sides, to further allow the seat surface 51 to deflect.

The seat 50 and rear legs 40 and 42 pivot with respect to the support frame 14 between (i) the first, open, unfolded position, as shown in FIGS. 1 and 2, and (ii) the second, closed, folded position, as shown in FIG. 3. The leg pivot points 46 preferably are located on a straight section of the support frame 14, or first and second side supports 18 and 20, or at a mid-section of the composite curve. Thus, holes for the pivot point 46 may be formed in the side supports 18 and 20 prior to bending the support frame 14 during the manufacturing process. If the holes are located on curved portions of the support frame 14, then forming the holes prior to bending may cause the holes to be mis-shaped as the curve portion of the support frame is formed.

The location of leg pivot points 46 facilitates a chair having a curved spline. By locating the pivot points 46 at the mid-section. of a composite curve, or at the intersection of two linear members, the relative shear and load stresses (combined stresses), as well as the strain, in the frame 14 are at a minimum. The stress is high at the leg pivot points 46 because the real legs 40 and 42 act as lever arms to concentrate the force.

Referring to FIG. 3, the seat 50 and rear legs 40 and 42 advantageously pivot such that a majority of the seat 50 and a majority of the rear legs 40 and 42 collapse within a volume defined by the support frame 14. Thus, in the folded position, the chair 10 substantially maintains the curved spline profile of the support frame 14. The chair 10 (or the support frame 14, seat 50 and rear legs 40 and 42) also advantageously has a curved spline profile in the closed position, with the profile having a substantially uniform thickness, which is relatively thin. The volume defined by the support frame 14, is the space between the side supports 18 and 20. Thus, the seat 50 and rear legs 40 and 42 pivot such that a majority of the seat 50 and rear legs 40 and 42 fold directly between the side supports 18 and 20.

The seat 50 and rear legs 40 and 42 collapsing within the volume of the frame 14 provides a distinct advantage over prior art folding chairs, in which the seat and legs fold inwardly and onto the frame such that the frame, legs and seat each add a thickness dimension to form a relatively thick stack. In addition, the curved spline profile of the chair 10 in the folded position provides a distinct advantage over the prior art chairs, in which the profiles are straight and/or bulky. The chairs 10 of the present invention are capable of not only folding into a relatively thin profile in order to save storage space, but also forming a continuously and similarly shaped profile in which the profiles of adjacent chairs may be matched or nested to increase stability of the chairs in a stacked and stored relationship.

As illustrated in FIG. 4, a storable folding chair system, indicated generally at 60, may include a plurality of the above described chairs, including, for example, a first chair 10 and a second chair 62. The curved spline profile of the first folded chair 10 nests or indexes with the curved spline profile of the second folded chair 62 to resist relative motion of the two chairs 10 and 62 when disposed adjacent one another in an adjacent storage relationship. Referring again to FIG. 3, the curvature of the profile creates a protrusion or protruding portion 66 of the profile and an opposite matching indentation or recess 68 in the profile as the profile deviates from a straight line into a curvature. Thus, referring to FIG. 4, the protrusion 66 of the profile of the first chair 10 nests or indexes within the indentation or recess 68 of the profile of the second chair 62. Unlike many prior art folding chairs, which include a backrest portion which protrudes from the straight thick profile of the chair into the straight thick profile of an adjacent chair, the entire profile of the chair 10 of the present invention simultaneously forms the protrusions 66 and indentations 68 such that it is the entire profile of the chairs 10 and 62 which match to nest.

Referring again to FIGS. 1 and 2, the front legs 32 and 34 are preferably curved, and may be convex, as shown. The rear legs 40 and 42 are advantageously similarly curved so that the rear legs 40 and 42 may substantially collapse within the volume defined by the front legs 32 and 34. Referring specifically to FIG. 2, both the front and rear legs 28 and 38 have a radius of curvature, with the radius of curvature 27 of the rear legs 40 and 42 being smaller than the radius of curvature 29 of the front legs 32 and 34. The smaller radius of curvature 27 of the rear legs 40 and 42 allows a greater portion of the rear legs 40 and 42 to collapse within the volume defined by the front legs 32 and 34.

Referring to FIG. 3, the smaller radius of curvature of the rear legs 40 and 42 also allows a portion of the bottom ends 72 of the rear legs 40 and 42 to protrude or extend outside the volume defined by the front legs 32 and 34. Although it is desirable to have a majority of the seat 50 and rear legs, 40 and 42 collapse within the profile of the frame 14, the bottom ends 72 of the rear legs 40 and 42 extend outside of the volume of the front legs 32 and 34 to increase the stability of multiple stacked chairs. Referring to FIG. 4, it can be seen that the bottom ends 72 of the rear legs 42 of the first chair 10 protrude slightly from the profile of the first chair 10, and into the profile, specifically of the front legs 34, of the second chair 62. Therefore, the curved spline profile of the chairs 10 and 62 resists relative movement between the two chairs 10 and 62 in a longitudinal direction (or top to bottom direction), and the bottom end 72 of the first chair 10 protruding into the profile of the second chair 62 resists lateral relative motion (side-to-side) between the two chairs 10 and 62.

Referring again to FIG. 1, the chair 10 may further include front and rear cross support members 76 and 78. The front cross support member 76 is coupled to and between the front legs 32 and 34 near the bottoms thereof Similarly, the rear cross support member 78 is coupled to and between the rear legs 40 and 42. It will be appreciated that the front cross support member 76 is located between the front legs 32 and 34 and within the volume defined by the front legs 32 and 34, and thus may interfere with the rear legs 40 and 42 as they collapse into the volume defined by the front legs 32 and 34. Therefore, the forward cross support member 76 is preferably located closer to a forward surface 82 of the support frame 14 or front legs 32 and 34 than a rearward, surface 84. Positioning the front cross support member 76 closer to the forward surface 82 allows more room for the rear legs 40 and 42 to collapse into the volume defined by the front legs 32 and 34.

In addition, the front cross support member 76 may have left and right, or first and second, rear facing channels or indentations 88 and 90, formed at opposite ends thereof where the front cross support member 76 is attached to the front legs 32 and 34. Thus, as the rear legs 40 and 42 collapse within a volume defined by the front legs 32 and 34, the rear legs 40 and 42 are received within the first and second rear facing channels or indentations 88 and 90, respectively, so that the rear legs 40 and 42 are allowed to collapse further within the volume without being hindered by the front cross support member 76.

Furthermore, the front cross support member 76 may include left and right, or first and second, forward facing channels or indentations 92 and 94. The forward facing channels 92 and 94 receive the rear legs of an adjacent second chair such that the two chairs may index or nest, with the rear legs of the second chair extending into the forward facing channels 92 and 94 and between the front legs 32 and 34 of the first chair.

The folding chair 10 also includes left and right, or first and second folding systems, represented by the second or right folding system 100, formed by and pivotally coupling the frame 14, seat 50 and respective first and second rear legs 40 and 42 together, as described in co-pending U.S. patent application Ser. Nos. 09/425,580, filed Oct. 22, 1999, entitled "FOLDING MECHANISM FOR FOLDING CHAIR", and 09/425,577, filed Oct. 22, 1999, entitled "FOLDING MECHANISM WITH KICK-OUT TAB FOR FOLDING CHAIR", which are herein incorporated by reference. The folding system 100 allows the various components of the chair 10 to fold as thinly as possible in the folded position, and provides strength to the seat in the open position.

In addition, the folding chair 10 includes a flexible back support 156 coupled to the upper back support portion 24 of the support frame 14, and a lower lumbar region or member

160, as described in co-pending U.S. patent application Ser. No. 09/425,596, filed Oct. 22, 1999, entitled "FOLDING CHAIR WITH LUMBAR SUPPORT AND FLEXIBLE BACK SUPPORT", which is herein incorporated by reference.

The folding chair 10 also may include an upward projecting alignment member 200 associated with the seat 50 or seat surface 51, as described in co-pending U.S. patent application Ser. No. 09/425,850, filed Oct. 22, 1999, entitled "INDEXING SEAT FOR FOLDING CHAIR", which is herein incorporated by reference.

In addition, the folding chair 10 may include front and rear indexing feet 210 and 214, as described in co-pending U.S. patent application Ser. No. 09/425,264, filed Oct. 22, 1999, entitled "INDEXING FEET FOR FOLDING CHAIR", which is herein incorporated by reference.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A folding chair comprising:

a rigid support frame having an upper back support portion and extending forwardly to form integral lower front leg portions, the rigid support frame shaped to form a curved spline profile;

rear legs pivotally coupled to the rigid support frame; and a seat pivotally coupled to the rigid support frame, the seat and the rear legs pivoting with respect to the rigid support frame between an open unfolded position, and a closed folded position, a majority of the seat and a majority of the rear legs collapsing within a volume defined by the rigid support frame; and the upper back support portion being substantially concave, and the lower front leg portions being substantially convex.

2. The folding chair of claim 1, wherein the rigid support frame is shaped to form a composite curve.

3. The folding chair of claim 2, wherein the composite curve is s-shaped.

4. The folding chair of claim 1, further comprising:

first and second folding systems pivotally coupling respective first and second rear legs, the rigid support frame, and the seat together, such that the folding chair may fold from an opened to a closed position.

5. The folding chair of claim 1, wherein the rigid support frame further comprises first and second side supports each having upper and lower portions integrally connected at opposite ends of a curved portion.

6. The folding chair of claim 5, wherein the upper portion includes a linear portion integrally connected with a concave portion, and the lower portion includes a linear portion integrally connected with a convex portion, wherein the concave portion converges with the convex portion at a point substantially within a mid-section of each of the first and second side supports forming a composite curve.

7. The folding chair of claim 6, wherein the seat is pivotally coupled at a pivot point, and wherein the pivot point is located at the midsection of the composite curve.

8. The folding chair of claim 1, wherein the front leg portions and the rear legs are curved in the same direction, and wherein the rear legs fold substantially between the front leg portions in the closed folded position to form the curved spline profile.

9. The folding chair of claim 1, wherein the front leg portions and rear legs are curved; wherein the rear legs have a radius of curvature smaller than a radius of curvature of the front leg portions; and wherein the rear legs pivot substantially between the front leg portions in the closed folded position such that the upper back support portion, the front leg portions, and the rear legs define a curved spline profile.

10. The folding chair of claim 1, wherein a bottom portion of the rear legs extends beyond the volume defined by the rigid support frame when the chair is in a folded position, such that the bottom portion of the rear legs nest with front leg portions of a second adjacent folding chair.

11. The folding chair of claim 1, further comprising:

front and rear cross support members to respectively couple together the front leg portions and the rear legs; and wherein the front and rear cross support members have left and right channels for substantially receiving a section of a rigid support frame of a second folding chair.

12. The folding chair of claim 1, wherein the seat is pivotally coupled to the support frame at a rearward location of the seat such that substantially all of the seat folds in a downward direction when moved toward the folded position.

13. The folding chair of claim 1, wherein the curved spline profile forms a protrusion and a recess such that a protrusion of a first folding chair may nest with a recess of a second folding chair.

14. The folding chair of claim 1, wherein the support frame, the seat and the rear legs have a curved spline profile of substantially uniform thickness in the closed folded position.

15. A folding chair comprising:

an upper back support portion and associated seat member;

a lower front leg portion integrally connected to the upper back support portion to form a curved spline profile, the upper back support portion and the lower front leg portion forming a rigid support frame; and rear leg portions pivotally coupled to the support frame, a majority of the rear leg portions collapsing within a volume defined by the support frame; and the curved spline profile of the chair having a substantially uniform thickness in a closed folded position; and the curved spline profile forming a composite curve that is s-shaped.

16. The folding chair of claim 15, wherein the curved spline profile forms a composite curve.

17. The folding chair of claim 15, wherein the front leg portions and the rear leg portions are curved in the same directions, and wherein the rear leg portions fold substantially between the front leg portions in a closed folded position to form the curved spline profile.

18. The folding chair of claim 15, further comprising first and second folding systems pivotally coupling the respective rear leg portions, the rigid support frame, and the seat member together, such that the folding chair may fold between an opened and a closed position.

19. The folding chair of claim 15, wherein the rear leg portions are substantially curved and fold between the rigid support frame such that the folding chair defines a curved spline profile in a folded position.

20. The folding chair of claim 15, wherein the upper back support portion has a substantially concave curvature and the lower front leg portion has a substantially convex curvature; wherein the upper back support portion and the lower front leg portion are integrally connected and converge at a point substantially within a mid-section of the rigid support frame forming a composite curve.

21. The folding chair of claim 20, wherein the associated seat member is pivotally coupled at a pivot point, and wherein the pivot point is located at the midsection of the composite curve.

22. The folding chair of claim 15, wherein the front leg portion and the rear leg portions are curved; and wherein the rear leg portions have a radius of curvature substantially smaller than a radius of curvature of the front leg portion, such that the rear leg portions pivot substantially between the lower front leg portion in a closed folded position, such that the upper back support portion, the lower front leg portion, and the rear leg portions define a curved spline profile.

23. The folding chair of claim 15, wherein the rear leg portions have a radius of curvature smaller than a radius of curvature of the lower front leg portion and have a bottom portion which extends beyond the lower front leg portion in a folded position, the bottom portion of the rear leg portions nesting with a front leg portion of a second, adjacent stacked chair.

24. The folding chair of claim 15, further comprising:

front and rear cross support members coupled to and between the respective front leg portion and rear legs portions.

25. The folding chair of claim 24, wherein the front and rear cross support members have left and right channels for receiving a section of a rigid support frame of a second folding chair.

26. The folding chair of claim 15, wherein the associated seat member is pivotally coupled at a rearward location such that substantially all of the associated seat member folds in a downward direction.

27. The folding chair of claim 15, wherein the curved spline profile forms a protrusion and a recess such that a protrusion of a first folding chair may nest with a recess of a second folding chair.

28. A folding chair comprising:

a support frame including first and second rigid side supports having back support portions and extending forwardly to form front leg portions, the support frame shaped to form a curved spline profile;

rear leg portions pivotally coupled to the support frame;

a back support coupled to the back support portions of the support frame; and a seat pivotally coupled to the first and second rigid side supports of the support frame;

the support frame, the seat, and the rear leg portions being pivotally coupled together and pivoting relative to one another between:

an opened position; and a closed position wherein a majority of the rear leg portions and a majority of the seat fold substantially within a volume defined between the first and second rigid side supports to form a curved spline profile; and the front leg portions and the rear leg portions being curved in the same direction, and the rear leg portions folding substantially between the front leg portions in the closed position to form the curved spline profile.

29. The folding chair of claim 28, wherein the rigid support frame is shaped to form a composite curve.

30. The folding chair of claim 29, wherein the composite curve is s-shaped.

31. The folding chair of claim 28, wherein the support frame, the seat and the rear legs have a curved spline profile of substantially uniform thickness in the closed folded position.

32. The folding chair of claim 28, further comprising:

first and second folding systems pivotally coupling respective first and second rigid side supports, the rear leg portions, and the seat together, such that the folding chair may fold from the opened to the closed position.

33. The folding chair of claim 28, wherein the back support portions include a linear portion integrally connected with a concave portion, and the front leg portions include a linear portion integrally connected with a convex portion, wherein the concave portion converges with the convex portion at a point substantially within a mid-section of each of the first and second side supports forming a composite curve.

34. The folding chair of claim 33, wherein the seat is pivotally coupled at a pivot point, and wherein the pivot point is located at the midsection of the composite curve.

35. The folding chair of claim 28, wherein the back support portions are substantially concave, and the front leg portions are substantially convex.

36. The folding chair of claim 28, wherein the front leg portions and rear leg portions are curved; wherein the rear leg portions have a radius of curvature smaller than a radius of curvature of the front leg portions; and wherein the rear leg portions pivot substantially between the front leg portions in the closed folded position, such that the upper back support portions, the front leg portions, and the rear legs define a curved spline profile.

37. The folding chair of claim 28, wherein a bottom portion of the rear leg portions extends beyond the volume defined by the rigid support frame when the chair is in a folded position, such that the bottom portion of the rear leg portions nests with front leg portions of a second adjacent folding chair.

38. The folding chair of claim 28, further comprising:

front and rear cross support members respectively coupling together the front leg portions and the rear leg portions; and wherein the front and rear cross support members have left and right channels for substantially receiving a section of a rigid support frame of a second folding chair.

39. The folding chair of claim 28, wherein the seat is pivotally coupled to the support frame at a rearward location of the seat such that substantially all of the seat folds in a downward direction when moved toward the folded position.

40. The folding chair of claim 28, wherein the curved spline profile forms a protrusion and a recess such that a protrusion of a first folding chair may nest with a recess of a second folding chair.

41. A folding chair comprising:

a first rigid support member having an upper back support portion and a first front leg, the back support portion and the first front leg being integrally and rigidly connected to form a curved spline profile;

a second rigid support member having an upper back support portion and a second front leg, the back support portion and the second front leg being integrally and rigidly connected to form a curved spline profile;

a seat pivotally coupled to and between the first and second support members, a majority of the seat collapsing to a folded position within a volume defined between the first and second rigid support members;

a back support coupled to and between the back support portions of the first and second support members; and first and second rear legs, pivotally coupled to the first and second support members, respectively, a majority of the first and second rear legs collapsing to a folded position within the volume defined between the first and second rigid support members; and the front legs and rear legs are curved;

the rear legs have a radius of curvature smaller than a radius of curvature of the front legs; and the rear legs pivot substantially between the front legs the in closed folded position such that the upper back support portion, the front legs, and the rear legs define a curved spline profile.

42. The folding chair of claim 41, wherein the first and second support members, the seat and the rear legs have a curved spline profile of substantially uniform thickness in the closed folded position.

43. The folding chair of claim 41, wherein the first and second support members are shaped to form composite curves.

44. The folding chair of claim 43, wherein the composite curves are s-shaped.

45. The folding chair of claim 41, further comprising:

first and second folding systems pivotally coupling respective first and second support members, the first and second rear legs, and the seat together, such that the folding chair may fold from an opened to the closed position.

46. The folding chair of claim 41, wherein the back support portions include a linear portion integrally connected with a concave portion, and the front legs include a linear portion integrally connected with a convex portion, wherein the concave portion converges with the convex portion at a point substantially within a mid-section of each of the first and second support members forming a composite curve.

47. The folding chair of claim 46, wherein the seat is pivotally coupled at a pivot point, and wherein the pivot point is located at the midsection of the composite curve.

48. The folding chair of claim 41, wherein the upper back support portion is substantially concave, and the front leg portions are substantially convex.

49. The folding chair of claim 41, wherein the curved spline profile forms a protrusion and a recess such that a protrusion of a first folding chair may nest with a recess of a second folding chair.

50. The folding chair of claim 41, wherein a bottom portion of the rear legs extends beyond the volume defined by the rigid support members when the chair is in a folded position, such that the bottom portion of the rear legs nest with front leg portions of a second adjacent folding chair.

51. The folding chair of claim 41, further comprising:

front and rear cross support members to respectively couple together the front legs and the rear legs; and wherein the front and rear cross support members have left and right channels for substantially receiving a section of a rigid support frame of a second folding chair.

52. The folding chair of claim 41, wherein the seat is pivotally coupled to the support members at a rearward location of the seat such that substantially all of the seat folds in a downward direction when moved toward the folded position.

53. A storable folding chair system comprising:

a first folding chair having a support frame with front legs, a seat, and rear legs pivotally coupled together and pivotable to a folded position in which a majority of the rear legs and a majority of the seat fold substantially within a volume defined by the support frame to form a curved spline profile; and a second folding chair having a support frame with front legs, a seat, and rear legs pivotally coupled together and pivotable to a folded position in which a majority of the rear legs and a majority of the seat fold substantially within a volume defined by the support frame to form a curved spline profile wherein the curved spline profiles of the folding chairs substantially nest to resist relative motion in a stacked relationship.

54. The system of claim 53, wherein the curved spline profiles of the first and second chairs form protrusions and recessions such that a protrusion in the first chair is received within a recess of the second chair, and a protrusion of the second chair is received in a recess of the first chair.

55. The system of claim 53, wherein the folding chairs have a curved spline profile of substantially uniform thickness in the folded position.

56. The system of claim 53, wherein the curved spline profiles have a composite curve.

57. The system of claim 53, wherein the curved spline profiles are s-shaped.

58. The system of claim 53, wherein the first and second folding chairs have matched indexing profiles which prevent the first and second folding chairs from sliding relative to one another in at least one direction.

* * * * *